US007708625B2

(12) United States Patent
Leseman et al.

(10) Patent No.: US 7,708,625 B2
(45) Date of Patent: May 4, 2010

(54) AIR INLET AND OUTLET HOOD

(75) Inventors: Gary T Leseman, Houston, TX (US); Joseph B Davis, Houston, TX (US)

(73) Assignee: L.C. Eldridge Sales Co., Ltd., Houston, TX (US)

( * ) Notice: Subject to any disclaimer, the term of this patent is extended or adjusted under 35 U.S.C. 154(b) by 0 days.

(21) Appl. No.: 11/773,888

(22) Filed: Jul. 5, 2007

(65) Prior Publication Data

US 2008/0009233 A1 Jan. 10, 2008

Related U.S. Application Data

(60) Provisional application No. 60/818,468, filed on Jul. 5, 2006.

(51) Int. Cl.
*F23J 13/08* (2006.01)
*F23J 13/06* (2006.01)
*F24F 13/08* (2006.01)

(52) U.S. Cl. ..... 454/4; 454/10; 454/41; 454/277; 454/368

(58) Field of Classification Search ..... 454/4, 454/10, 11, 275, 277, 358, 367, 368, 39, 454/41

See application file for complete search history.

(56) References Cited

U.S. PATENT DOCUMENTS 1,354,008 A * 9/1920 Vaughan et al. ..... 454/174
1,354,483 A * 10/1920 Holland ..... 96/390
1,871,225 A * 8/1932 Shurtleff ..... 55/467.1
2,232,027 A * 2/1941 Gunter ..... 454/363
2,448,048 A * 8/1948 Porter ..... 55/404
2,522,995 A * 9/1950 Coleman ..... 454/39
3,143,953 A * 8/1964 Bristol ..... 454/352
3,332,335 A * 7/1967 Hillstrom ..... 454/277
3,348,466 A 10/1967 Lane et al
3,358,580 A 12/1967 Freese et al.
3,401,624 A * 9/1968 Mohrman ..... 454/344
3,413,905 A * 12/1968 Johnson ..... 454/275
3,426,667 A * 2/1969 Johnson ..... 454/275
3,643,584 A * 2/1972 Sheppard ..... 454/275
3,771,430 A 11/1973 Lane
3,953,183 A 4/1976 Regehr
4,393,629 A * 7/1983 Gasparini et al. ..... 52/74
4,989,502 A * 2/1991 Ospelt ..... 454/275
5,542,224 A 8/1996 Olsen
5,779,539 A * 7/1998 Kolt ..... 454/368

(Continued)

FOREIGN PATENT DOCUMENTS

EP 311159 A1 * 4/1989

*Primary Examiner*—Steven B McAllister
*Assistant Examiner*—Patrick F. O'Reilly, III
(74) *Attorney, Agent, or Firm*—Locke Lord Bissell & Liddell LLP

(57) ABSTRACT

An inlet and/or outlet air hood comprising vertical storm louvers is provided that is particularly well suited for use on a Mobile Offshore Drilling Unit and other marine vessels, although its use is not so limited. The hood may comprise a basic cube shape, which affords a smaller projected footprint than conventional round- or mushroom-shaped hoods and may incorporate an internal flow shaper, such as an inlet/outlet bell, to reduce airflow resistance. In addition, the hood may be configured to incorporate an internal valve or baffle to create a watertight closure.

14 Claims, 2 Drawing Sheets

U.S. PATENT DOCUMENTS 5,839,244 A 11/1998 Johnson et al.
5,906,083 A * 5/1999 Olsen et al. ..... 52/473
6,311,445 B1 11/2001 Macander et al.
6,475,079 B1 11/2002 Basey
6,817,940 B2 * 11/2004 Pfannenberg ..... 454/184

* cited by examiner

AIR INLET AND OUTLET HOOD

CROSS REFERENCE TO RELATED APPLICATIONS

This application for patent claims benefit of and priority to U.S. Provisional Application Ser. No. 60/818,468, filed on Jul. 5, 2006, the full disclosure of which is incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to air inlet and outlet hoods for ventilating equipment and/or spaces.

2. Description of the Related Art

U.S. Pat. No. 3,771,430 discloses, according to the Abstract, An assembly of louver blades attached to a frame for positioning in a ventilating opening provided in the wall of a building and defining an air handling device through which air is free to flow. The louver blades may be disposed in either horizontal or vertical orientation. The flowing air traverses passageways defined by the louver blades, and eventually exits said passageways on the side opposite of its original entrance. Raindrops, which may have accompanied the air stream as airborne free water, are extracted to an acceptable degree through natural gravitational forces and other means whereby said water is caused to be deposited upon the surfaces of the louver blades. Drainage means are provided whereby the water is effectively drained from the louver blades to the exterior of the louver assembly and falls harmlessly to the ground.

U.S. Pat. No. 3,953,183 discloses, according to the Abstract, An apparatus for separating particles from a gas flow . . . comprising: . . . A plurality of corrugated separator plates arranged in spaced parallel relation to each other and defining wave-like flow channels between each other. The warped surfaces of the separator plates are generated in cross-section by at least three circular arcs connected continuously and with alternating directions of curvature. The radius of each of the three circular arcs is different, the radius of the arc representing the crest being the smallest. The arcs define at least one crest between two troughs, forming an intake section and an outlet-section, respectively of each separator plate. A first separating chamber is provided opening towards the gas flow on the convex side of the crest and is formed by a blade projecting from the downstream side of the crest toward its upstream side and running along the crest. A plurality of serrations running along underneath the crests [are] arranged opposite to the separating chambers of the crest of the adjacent separator plate. The smaller radius of the second arc and the serrations together with the separating chamber provide a narrowing of the duct toward the crest to increase the speed of the fluid flow. A collision occurs between the main upstream gas flow and a continuous gas flow recoil from the first separating chamber, causing a stationary micro-turbulence in the vicinity of the serrations without a significant loss of energy and speed, whereby even the smallest particles are separated by the serrations. Two additional separating chambers of specific cross-sections are provided strategically on the downstream past the crest, each retaining material particles not caught previously.

U.S. Pat. No. 5,542,224 discloses, according to the Abstract, A louver with vertical blades arranged in a frame alternately in a staggered relation from front to back in a front and a rear row. The blades in at least the front row have a web oriented substantially perpendicularly to the plane of the frame and substantially parallel to the jambs, a pair of front flanges extending in opposite directions generally laterally from a front edge of the web, and a pair of rear flanges extending in opposite directions generally laterally from a rear edge of the web. The webs subdivide the air flow volume within the frame into flow channels, each of which is partially blocked laterally by the front flanges and the rear flanges of the blades of the front row. The blades of the rear row have flanges that block the portions of the channels between the extremities of the flanges of the blades of the front row. The flanges of the adjacent blades overlap so that there is no straight path through the flow channels along which air and water entrained in the air can pass perpendicularly to the plane of the frame and the air flows along a tortuous flow path of approximately constant area. The flanges are configured to control and trap water impinging on them.

U.S. Pat. No. 5,839,244, according to the Abstract, "A storm louver (10, 12) having a plurality of spaced blades (16*a*, 16*b*, 16*c*, 16*d*) for removing water particles from air flowing into a building or air handling equipment is disclosed. Each louver (10, 12) has an improved blade support frame (18) that permits the blades (16*a*, 16*b*, 16*c*, 16*d*) to be more quickly and easily installed in the support frame (18) and that more firmly supports the blades. A modular louver system including at least two individual louvers that can be easily connected for installation in openings of any size is also disclosed."

In U.S. Pat. No. 6,311,445, according to the Abstract, A modular louver system is disclosed which utilizes a series of joined frames having the same basic cross section, a series of spacers, and a series of louver vanes having the same v shaped cross section. The frames have a t-shaped channel, with inwardly facing channel lips defining the narrow portion of the t-shaped channel. The louver vanes have a dovetail at each end, where the dovetail neck will fit in the area defined by the inwardly facing channel lips. In addition, the spacers are shaped so that they will rest in the t-shaped channel and will either separate the louver vanes from each other or from an adjacent frame. The louver vane dovetails are inserted in the t-shaped channels of opposing frames, with at least one spacer inserted in the t-shaped channels to separate the louver vanes from each other and from an adjacent frame. Where [a] rectangular connection is desired, the frames are connected either [sic] using a clip joint arrangement. Where the modular louver system uses rounded corners, a corner frame is used to allow for a rounded edge.

U.S. Pat. No. 6,817,940 discloses, according to its Abstract, An airflow unit, especially a filter fan or discharge filter with or without a fan for installation in an installation opening in a wall, especially a housing for components that produce waste heat, includes a ventilation grating composed of a frame holding a filter medium, a support member with a frame having a peripheral wall surface which expands outwardly, wherein the support member is provided with airflow openings and with water-diverting wings or rib formations. A shielding grating is inserted in the support member on a side facing away from the ventilation grating. An IP seal is foamed onto the support member for protection against splash water and spray water. All components of the airflow unit are held together by clamp or screw connections. The airflow unit is placed on the outer wall surface of the wall of the housing and is preferably detachably connected with the housing wall.

BRIEF SUMMARY OF THE INVENTION

One aspect of the present invention comprises a ventilation device comprising a body defining an interior plenum; a ventilation element coupled to the body and comprising a top portion, a bottom portion and two side portions, each portion having associated therewith a flange, the ventilation element comprising a plurality of spaced-apart, vertically arranged blades disposed between the side portions and adapted to trap airborne water, transport the water to the bottom of the element and permit air to enter the plenum, the bottom portion adapted to allow trapped water to exit the element; an exit in the body communicating with the plenum to establish a ventilation path through the element into the plenum and through the exit; and a valve disposed in the plenum and configured to seal the exit.

DETAILED DESCRIPTION

Figure 1:
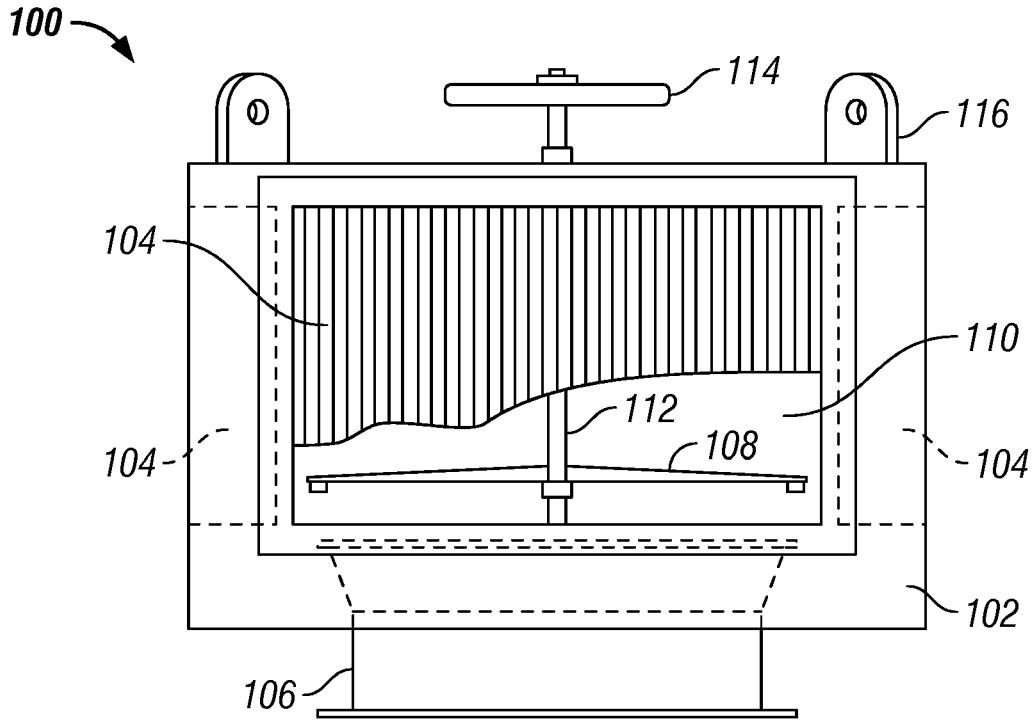
FIG. 1 illustrates a partial cross-sectional side view of one embodiment of the present invention.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Particular embodiments of the invention may be described below with reference to block diagrams and/or operational illustrations of methods. It will be understood that each block of the block diagrams and/or operational illustrations, and combinations of blocks in the block diagrams and/or operational illustrations, can be implemented by analog and/or digital hardware, and/or computer program instructions. Such computer program instructions may be provided to a processor of a general-purpose computer, special purpose computer, ASIC, and/or other programmable data processing system. The executed instructions may create structures and functions for implementing the actions specified in the block diagrams and/or operational illustrations. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Applicants have created a unique inlet and/or outlet (e.g., exhaust) air hood. This invention is particularly well suited for use with vertical storm louvers on a Mobile Offshore Drilling Unit (MODU) and other marine vessels, although its use is not so limited. Embodiments may be designed for holding and retaining vertical storm louvers that are adapted to remove some or all of airborne rain or water at relatively high air velocities and with low airflow resistance. The hood may comprise a basic cube shape, which affords a smaller projected footprint than conventional round- or mushroom-shaped hood. The hood may be adapted to couple directly, such as by bolting or welding, to an inlet or exhaust fan or ducting, such as a fan or ducting above the main deck of a MODU or marine vessel. The hood may incorporate an internal flow shaper, such as an inlet/outlet bell, to reduce airflow resistance. The hood may be configured to incorporate one or a plurality of vertical storm louvers as the air volume and application requires. Also, the hood may be configured to incorporate an internal valve or baffle to create a watertight closure.

Turning now to a more detailed description of a particular embodiment of the present invention, FIG. 1 illustrates one embodiment of a hood 100 comprising a body portion 102 preferably fabricated from a metal alloy, such as aluminum, steel or stainless steel. Alternately, the hood may be fabricated from other materials such as composites, fiberglass, or other metal alloy systems. The hood of FIG. 1 is illustrated to be basically cubic in shape, although it will be appreciated that the shape of the body portion 102 may be dictated by, among other things, the available space in which the hood 100 will be placed, and/or the size and shape of the elements 104.

Figure 2:
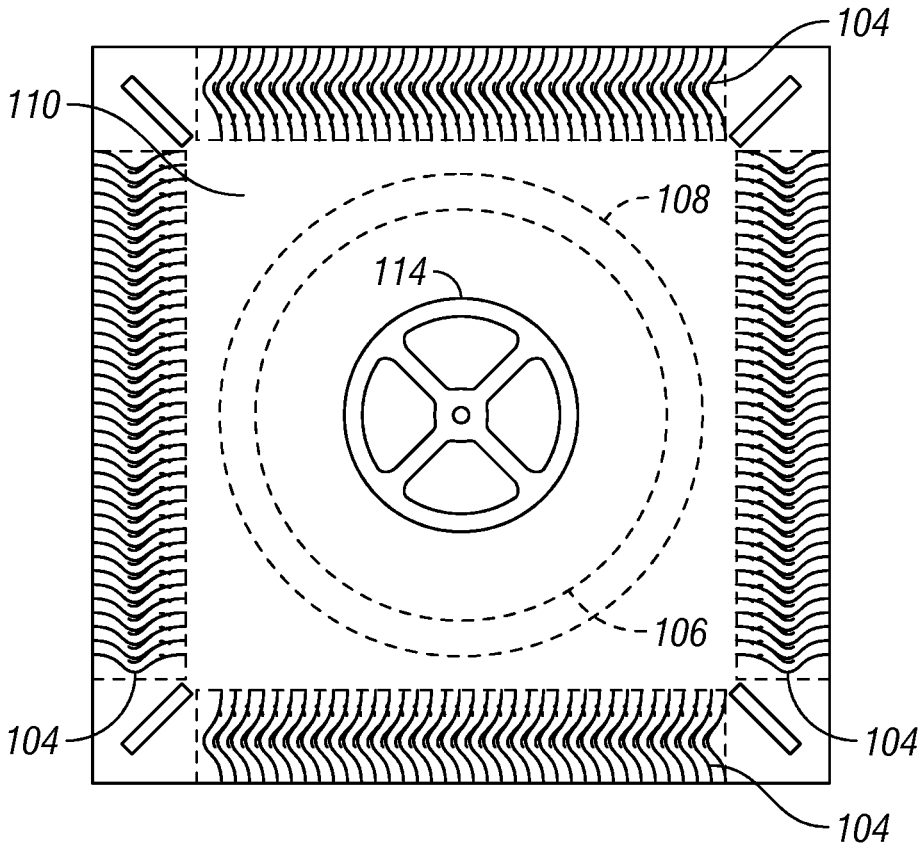
FIG. 2 illustrates a partial cross-sectional top view of the embodiment shown in FIG. 1.

As shown in FIG. 2, hood 100 is configured to accept four elements 104 associated with each of the vertical faces of body portion 102. Each element 104 is preferably a mechanical type of filter, specifically adapted to prevent, for example, the ingress of water, such as rain or wind blown water. Depending on the shape of the body portion 102, one or more elements 104 may be used.

Figure 3:
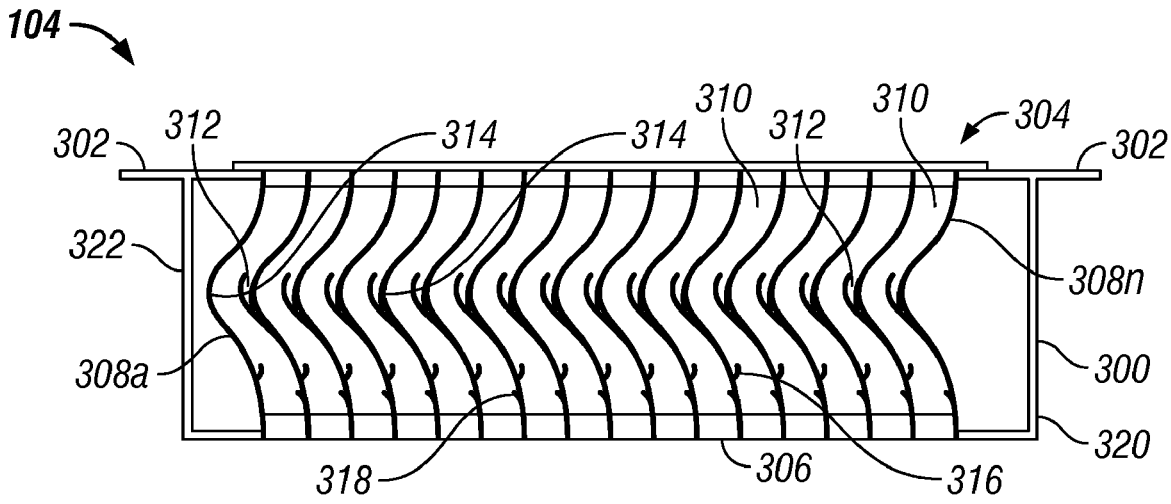
FIG. 3 illustrates a cross-sectional top view of a louver element particularly suited for use with hoods according to the present invention.

FIG. 3 illustrates a presently preferred type of element 104 for use with certain embodiments of the present invention, such as those illustrated in FIGS. 1 and 2. Element 104 may comprise a rectangular body 300, such as a square, having mounting flanges 302 on an exterior surface 304. Disposed between the exterior surface 304 and an interior surface 306 are a plurality of louvers or blades 308*a* through 308*n*. Each blade 308 extends substantially the height of the element 104, and as shown in FIG. 3, preferably comprises a generally arcuate, sinusoidal or bell curve shape. The louvers 308 are stacked within the body 300 in such manner that the louvers "nest" with one another to form a plurality of fluid flow paths 310 of substantially the same configuration as the individual louvers 308 that define the flow path 310. In addition, each flow path 310 has a trap 312 that runs substantially the length of the blade 308 and that is formed substantially at the apex 314 of one of the louvers 308 in the flow path 310. As illustrated in FIG. 3, the trap 312 may formed by a portion of the convex side of the louver extending into the flow path 310. Each flow path 310 may also include ribs 316 and/or 318 on the downstream side of trap 312.

In operation, element 104 prevents or at least minimizes the amount of air borne water, such as rain that can be drawn into hood plenum 110. As water-laden air makes it way through the element 104, the curved path 310, the traps 312 and ribs 316 and/or 318 remove the water from the air. The removed water falls down the louvers 308 to the bottom side of the element 104 where the water is allowed to drain out.

It is presently preferred that the element 104 be constructed from an extruded aluminum alloy, such as, for example, 6063-T5 with a continuous welded construction. The blades 308 may be fabricated, preferably by extrusion, from the same type of aluminum alloy, or from plastic, and for most applications be about 0.081 inches thick. It is preferred that blades 308 be formed by an extrusion process and then cut to length.

As shown in FIG. 3, element 104 may comprise side portions 320 and 322. It is preferred that sides portions 320 and 322 be extruded and include flange 302. In addition, first blades 308*a* and/or 308*n* may be part of the extruded side portion 320 and/or 322. Alternately, the first blades 308*a* and/or 308*n* may be extruded separately from the side portions 320 and/or 322. In either case, individual blades 308 may be held in position within element 104 by various means, such as tongue and groove, welding, compression, tab lock or retainer bar 400 (see FIG. 4).

Figure 4:
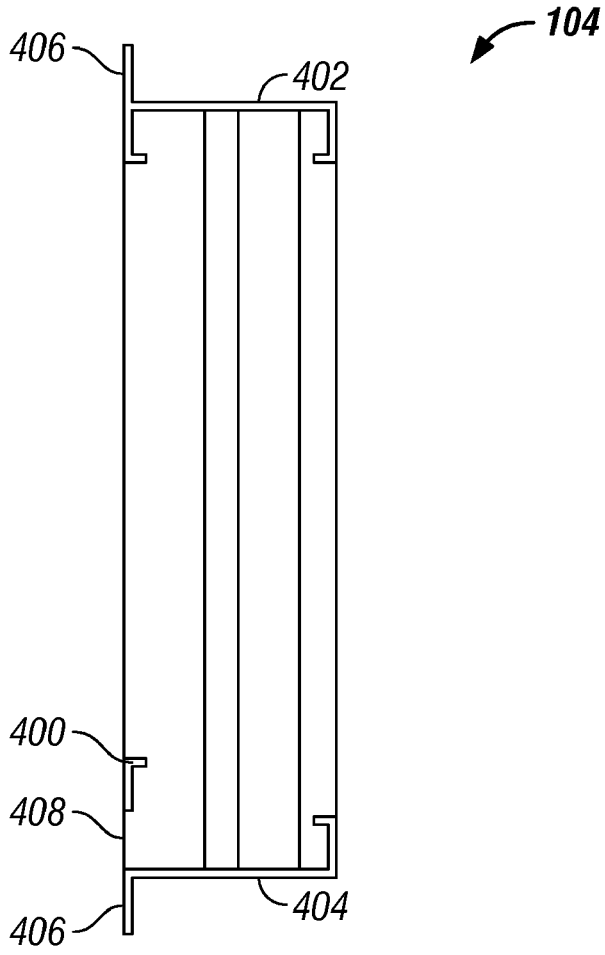
FIG. 4 illustrates a side view of the element shown in FIG. 3.

As shown in FIG. 4, element 104 may comprise top portion 402 and bottom portion 404, each of which is preferably fabricated by extrusion with integral flange 406. It will be noted that bottom potion 404 is unobstructed on the exterior face 408 of element 104 to facilitate drainage of trapped water.

It is preferred that the blades 308 be anodized to minimize corrosion, such as 215-R1 clear anodization for about 1 hour. Blade spacing may range between about 10 times and about 20 times the average blade thickness, and most preferably between about 10 times and 15 times the average blade thickness. Thus, for blades having an average thickness of about 0.081 inches, it is preferred to space the blades at about 1.0 to about 1.125 inches.

Returning to FIG. 1, body portion 102 has associated therewith a transition 106 coupled to body portion 102. Transition 106 is preferably adapted to minimize airflow restriction through the transition. Transition 106 is adapted to be coupled to the equipment or space, such as a workroom, that is ventilated. It will be appreciated that hood 100 may be attached to the equipment or space by bolting or welding or other conventional coupling techniques. As best shown in FIG. 1, water extracted from the air is allowed to drain out of the bottom of the element 104.

Also shown in FIGS. 1 and 2 is a baffle or valve 108 that can be used to seal the hood 100 in watertight fashion. In other words, valve 108 can be used to prevent water or other fluid from making its way into the equipment or engine room. For example, when used on offshore equipment, valve 108 may be closed when a storm, such as a hurricane, is approaching the offshore unit. As illustrated in FIG. 1, valve 108 may be actuated by a threaded mechanism 112 and associated handle 114. Alternately, valve 108 may be hydraulically, pneumatically, or electrically actuated. Lastly, the embodiment illustrated in FIG. 1 shows lifting lugs 116 for ease in handling and installation of hood 100.

Other and further embodiments utilizing one or more aspects of the inventions described above can be devised without departing from the spirit of Applicant's invention. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed is:

1. A ventilation device comprising:

a body defining an interior plenum and having at least two vertically-oriented sides, at least one side having an opening therein;

at least one ventilation element removably coupled at least partially in the at least one opening;

the ventilation element comprising a frame having a top portion, a bottom portion and two side portions, the ventilation element further comprising a flange having a portion extending outwardly from the frame and the outwardly extending portion coupling to an exterior surface of the body, and the ventilation element further comprising a plurality of spaced-apart, vertically arranged blades disposed within the frame and between the side portions, each blade adapted to remove airborne water, transport the water to the bottom of the ventilation element without retaining the water and permit air to enter the plenum, the bottom portion provided with an opening located outside of the exterior surface of the body to allow removed water to exit the ventilation element;

an exit in the body communicating with the plenum;

a transition structurally supporting the body and coupled to the exit to establish a ventilation path through the ventilation element into the plenum, through the exit, and into the transition;

a valve disposed within the ventilation path and comprising a sealing element that is displaceable in a direction of air flow between an opened position and a closed position, the closed position configured to watertightly seal the exit; and whereby water removed by the blades drains from the ventilation element and does not enter the plenum.

2. The ventilation device of claim 1, wherein the body defines a cube having four vertical faces, a top face and a bottom face.

3. The ventilation device of claim 2, wherein the four vertical faces of the body each have a ventilation element.

4. The ventilation device of claim 3, wherein the exit is associated with the bottom face.

5. The ventilation device of claim 1, wherein the blades are fabricated by extrusion.

6. The ventilation device of claim 5, wherein the blades are extruded from aluminum.

7. The ventilation device of claim 5, wherein the blades are extruded from plastic.

8. The ventilation device of claim 5, wherein the side portions of the element are extruded.

9. The ventilation device of claim 8, wherein the extruded side portions of the element each include an integrally extruded blade.

10. The ventilation device of claim 5, wherein the top and bottom portion of the element are extruded.

11. The ventilation device of claim 5, wherein the top, bottom and side portions of the element are extruded from aluminum.

12. The ventilation device of claim 11, wherein the extruded side portions of the element each include an integrally extruded blade.

13. The ventilation device of claim 1, further comprising a valve actuator selected from the group consisting of: a mechanical valve actuator, a hydraulic valve actuator, a pneumatic valve actuator, and an electric valve actuator.

14. The ventilation device of claim 13, wherein the valve is located in the interior plenum.

* * * * *